US005992187A

United States Patent [19]

Derman

[11] Patent Number: 5,992,187

[45] Date of Patent: Nov. 30, 1999

[54] LOCKABLE SHAFT RETAINER

[76] Inventor: Jay S. Derman, P.O. Box 949, Redondo Beach, Calif. 90277

[21] Appl. No.: 09/097,508

[22] Filed: Jun. 15, 1998

[51] Int. Cl.[6] ..... E05B 69/00

[52] U.S. Cl. ..... 70/58; 70/30; 70/34; 70/49

[58] Field of Search ..... 70/58, 18, 30, 70/49, 34, 39

[56] References Cited

U.S. PATENT DOCUMENTS

| | | | |
|---|---|---|---|
| 3,435,642 | 4/1969 | Pesco | 70/49 |
| 3,953,990 | 5/1976 | Nagel | 70/18 |
| 4,603,566 | 8/1986 | Kruehn et al. | 70/380 |
| 5,170,650 | 12/1992 | Kortenbrede | 70/49 |
| 5,275,027 | 1/1994 | Eklof et al. | 70/58 |
| 5,305,621 | 4/1994 | Broadwater | 70/58 |
| 5,761,934 | 6/1998 | Kuo | 70/49 |
| 5,806,354 | 9/1998 | Hasnik | 70/58 |

FOREIGN PATENT DOCUMENTS

| | | | |
|---|---|---|---|
| 63852 | 10/1891 | Germany | 70/39 |

*Primary Examiner*—Suzanne Dino Barrett
*Attorney, Agent, or Firm*—Monty Koslover Assoc.

[57] ABSTRACT

A shaft retainer device that comprises three major components: a barrel shaped housing, a leverable gripping assembly which is located inside the housing along its central axis, and a key lock in one end of the housing. When the device is locked, the gripping assembly radially grips any grooved shaft that has been inserted in the housing preventing shaft withdrawal. When unlocked by a key, the gripping assembly is spread apart, releasing its radial grip on the groove of any grooved shaft that has been previously inserted in the device. The shaft retainer will work equally well with any shaft that has a raised ridge or a stepped edge around its circumference, and can accommodate a range of shaft diameters. The device is small, light weight and economical to produce.

3 Claims, 5 Drawing Sheets

LOCKABLE SHAFT RETAINER

BACKGROUND OF THE INVENTION

1. Field of the Invention

This invention relates to locks, and more particularly to locks used for retaining and securing objects by means of cables, bolts or other shaft projections.

2. Background

Locks serving as shaft retainers have been available for a long time. A common practice for a shaft having an end with a transverse bored hole, is to connect a padlock through the hole in the shaft end. This is practical for applications where the shaft diameter is relatively large and can easily accommodate a padlock arm, but impractical for a small diameter shaft.

Cable shaft locking and retaining devices have also been used as far back as the mid 19th century period. Among the more recent cable retaining devices are those described by Smith in U.S. Pat. No. 5,517,835, Lyon et al in U.S. Pat. No. 3,987,653 and Joo in U.S. Pat. No. 4,099,394. Smith describes a device for use with a cable formed into two or more loops. A ferruled end of the cable is inserted in the device and one or more loops of the cable are also inserted in the device and pulled through. Turning a key lock in the device causes two or more wedge-shaped elements to grip the cable along its length inside the device, retaining the cable.

Lyon et al describe a device for locking a looped cable, One end of the cable is inserted and anchored to the device by a ring. The other end of the cable is passed through the device. The cable is clamped and partially deformed by turning a key lock that rotates a threaded shaft, activating a clamp around the cable. Joo describes storage reel for a cable which is hinged to a bicycle frame. In use, the cable is drawn around a post or other immovable object, and fastened to a projection on the bicycle, utilizing a padlock to lock it in place.

A recent example of a shaft projection retainer lock is that described by Stillwagon et al in U.S. Pat. No. 6,197,314. Stillwagon et al describe a device that includes the shaft projection and a key-turned lock that causes a sleeve or collar to grip the shaft projection. In this invention embodiment, the shaft projection may be fixed in a door or cabinet, or instead in the key-turned device with a collar-gripping portion fixed in a door to receive the projection. A later device by Stillwagon, U.S. Pat. No. 5,467,619 expands further on the above described second Stillwagon embodiment by incorporating a long, threaded shaft into the key-turned portion of the device. In the above described Stillwagon devices, the shaft projection must be particularly sized in length, stepped and/or threaded to fit its mating lock portion. This is because it is described as being part of the locking device. While useful for their described applications, the Stillwagon devices are not useful for retaining other shaft projections such as bolts, cable ends and the like.

In view of the foregoing, there is a need for a simple, universal locking device that can be applied to retain single shaft projections of various configurations.

SUMMARY OF THE INVENTION

The invention shaft retainer device comprises three major components: an open-ended retainer case, a clamshell type assembly which is located inside the case along its central axis, and a key lock assembly. When a key is rotated to the open position in the lock located at one end of the device, the clamshell assembly is caused to release its grip on any shaft projection that has been previously inserted in the distal open end of the device. If the shaft projection end has at least one deep groove, a raised ridge or a step around it, the shaft will be firmly retained when a key is rotated in the lock to the closed position and the key is withdrawn. The clamshell assembly opening expands to accommodate any diameter shaft projection up to the retainer case axial opening diameter. Thus each retainer device, depending on its size, can be used with a range of shaft projection diameters as well as different types of projections. The retainer device is small, light weight and economical to produce.

Accordingly, it is a principal object of the invention to provide a retainer device for lockable shafts that is universal in application to many shaft configurations and sizes.

Another object is to provide a lockable shaft retainer that is relatively simple in construction, while being universal in application to shafts of varying size and configuration.

An advantage of the invention is its economical production cost, relative to existing available devices.

Further objects and advantages of the invention will be apparent from studying the following portion of the specification, the claims and the attached drawings.

DESCRIPTION OF THE PREFERRED EMBODIMENT

Figure 1:
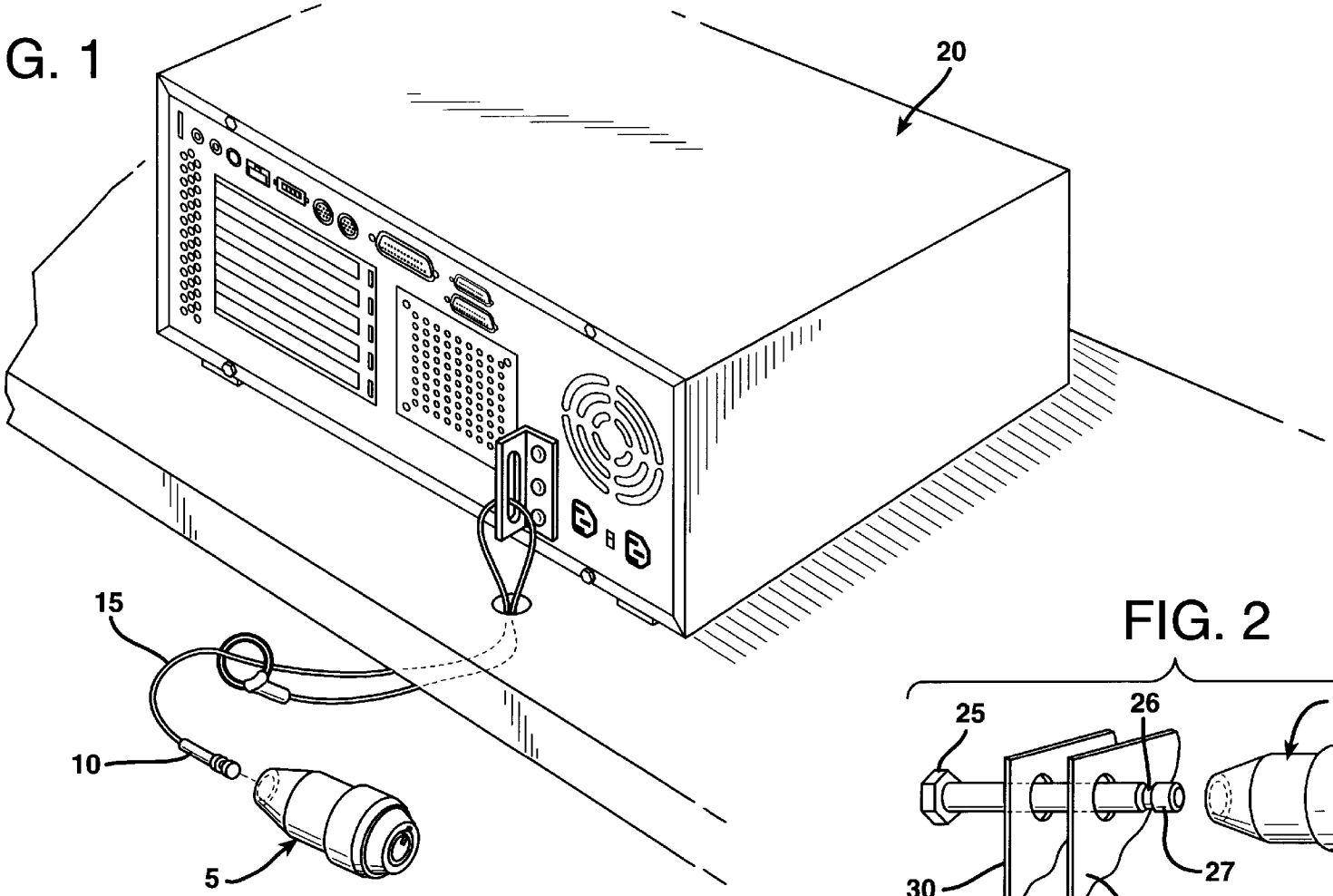
FIG. 1 is a view of the present invention shaft retainer ready to retain the end of a cable shaft which is attached to an electronic equipment.
Figure 2:
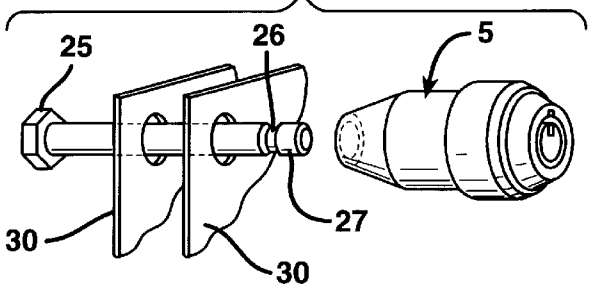
FIG. 2 shows the present invention shaft retainer ready for retaining the end of a grooved bolt which may hold equipment to a retaining base.

Referring particularly to the drawings, there is shown in FIGS. 1 and 2 perspective view of a preferred embodiment of the present invention shaft retainer 5 ready to retain a cable 15 shaft end 10 or a bolt shaft 27. In FIG. 1, the cable 15 is shown attached to an electronic equipment 20 and passing through a hole in a table, terminating with a shaft end 10 on which there is a grooved ferrule. When a key is turned to open the retainer 5, the cable shaft end 10 can be inserted in the retainer 5 axial opening. Turning the key back to its locked position and withdrawing the key will cause the retainer 5 to grip the cable and prevent the cable from being pulled through its attachment to the equipment 20.

In FIG. 2, a grooved 26 bolt 25 is shown passing through a hole in two metal pieces 30. The metal pieces 30 represent part of an equipment and part of a fixed base to which it is desired to fasten the equipment. A typical example could be a portable item that the owner wishes to secure. Insertion of the bolt end 27 into the retainer 5 and its release are effected in the same way as described above for the cable shaft end 10.

Figure 3:
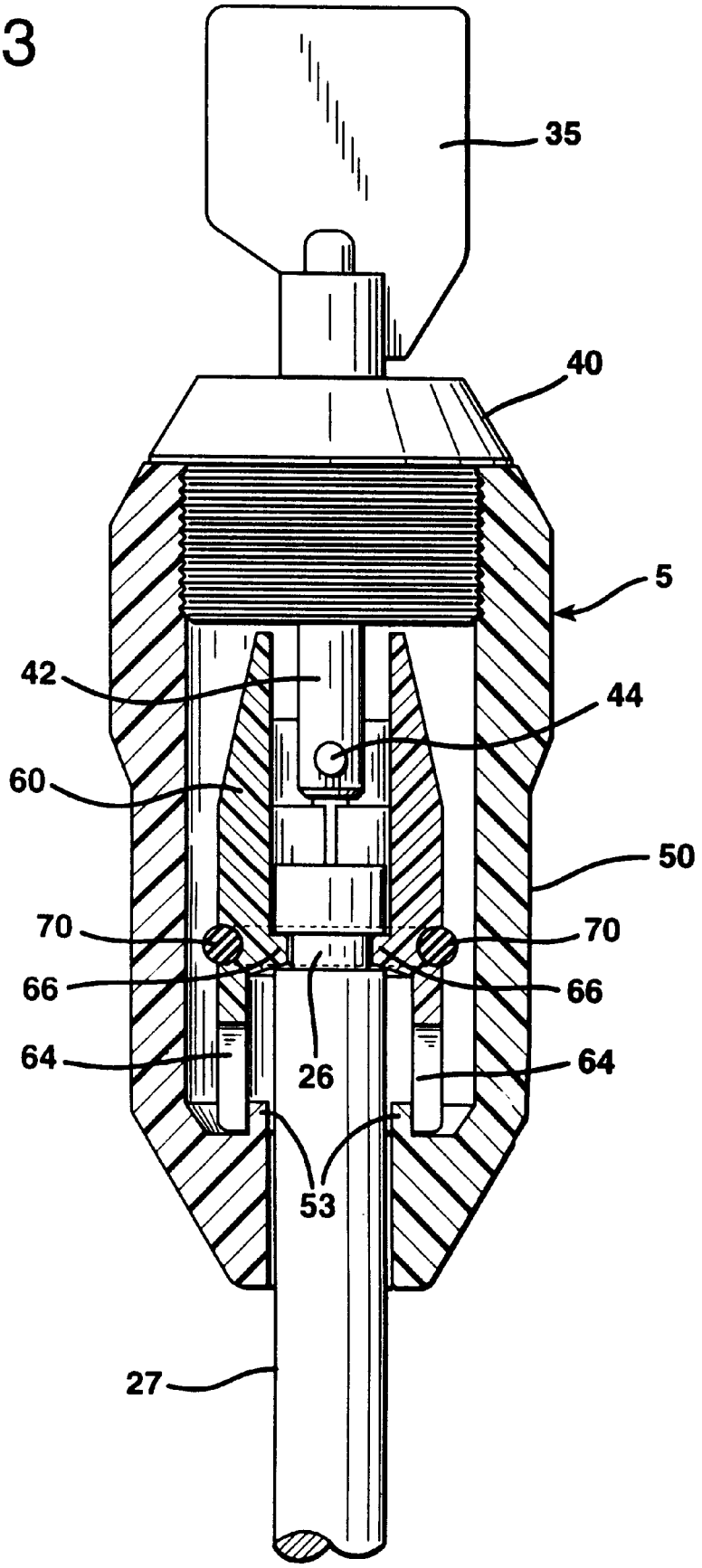
FIG. 3 is a side elevation cross-section view of the present invention with its key in its locked position, and showing an inserted grooved bolt gripped by a device gripping as assembly and prevented from being removed.
Figure 4:
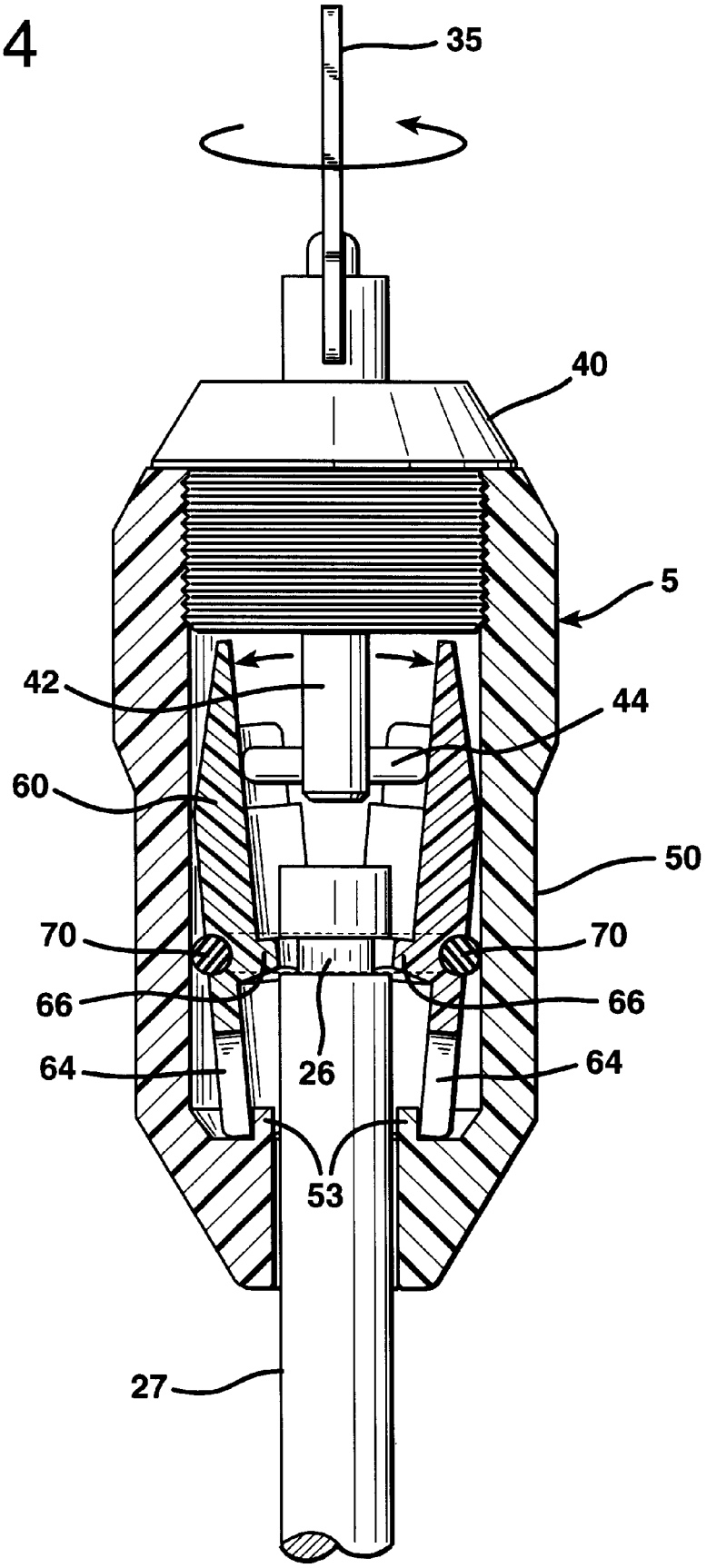
FIG. 4 is a side elevation cross-section view of the present invention in place, particularly showing its lock key rotated to its open position and its gripping assembly being held open, allowing an inserted grooved bolt to be removed from the retainer.

Refer now to FIGS. 3 and 4 which are side elevation cross-section views of a preferred embodiment of the present invention shaft retainer 5. In FIG.3, the retainer internal gripping means 60 is shown closed by means of a key 35 in a lock 40, and gripping an inserted grooved shaft 27. In FIG. 4, the retainer internal gripping means 60 is shown open or unlocked by means of a rotated key 35 in a lock 40, allowing the shaft 27 to be withdrawn or inserted in the retainer 5.

The shaft retainer 5 comprises a lock assembly 40, a retainer case 50, and a clamshell assembly 60 that serves as a means for expandably gripping in its jaws, the outer surface of any grooved or stepped shaft that is inserted in the retainer 5.

The lock assembly 40 has a shaft 42 that projects along the lock longitudinal axis and includes a pin or cam 44 that projects through the shaft 42 at 90 degrees to the shaft rotational axis. When the lock key 35 is inserted and rotated as depicted in FIG. 4, the lock shaft cam 44 applies pressure to the inside surfaces of the top portion of the clamshell assembly 60, forcing the clamshell members apart at its top end and at is middle. As shown, the bottom ends 64 of clamshell members pivot around a raised ledge 53 at the bottom of the case 5 internal cavity.

Approximately two-thirds down the length of the clamshell assembly 60 is located an expandable ring 70 that fits into a groove around the clamshell members, applying constant pressure to hold the clamshell members together. Immediately opposite the ring 70 groove, but on the inside surface of the clamshell assembly is a sharply projecting ridge 66 shaped with a concave curve cut out. The curved portion of this ridge 66 grips a grooved shaft in its groove 26 when the retainer is locked as shown in FIG. 3.

The construction allows varying shaft diameters to be inserted into the retainer 5 to be gripped by the clamshell assembly. Thus, a range of shaft sizes can be accommodated by any given shaft retainer.

The clamshell assembly 60 fits inside the retainer case 50 in one orientation only and with its lower portion downwards. In addition, for correct operation, the clamshell assembly 60 must not be allowed to rotate with respect to the retainer case 50. This is accomplished by keying means inside the case 50 which cooperate with openings in the clamshell assembly 60 and are now discussed.

Figure 5:
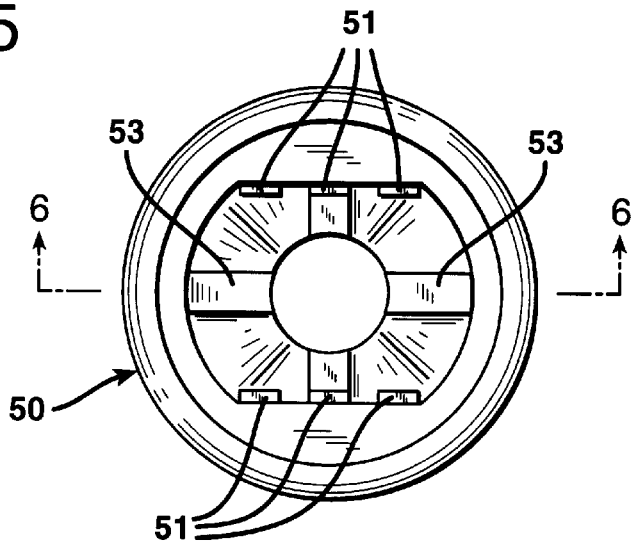
FIG. 5 is a top view of the retainer case according to the present invention.
Figure 6:
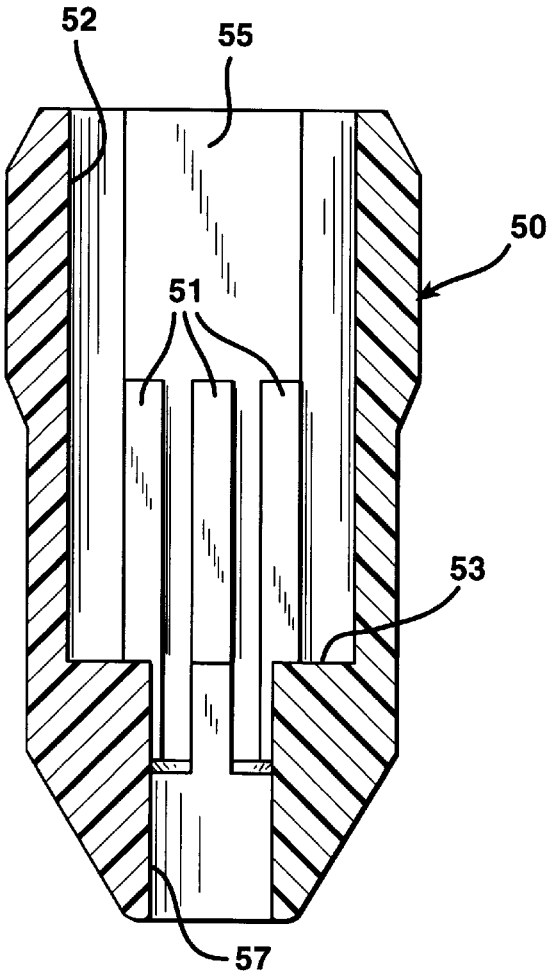
FIG. 6 is a side elevation cross-section view of the retainer case taken along line 6—6 of FIG. 5, particularly showing projections used for keying in place a gripping assembly that will be inserted therein.

Referring now to FIGS. 5 and 6, there are shown respectively, a top end view of a retainer case 50 and a side elevation view of the case cavity cut away on line 6—6 of FIG. 5. Raised along the longitudinal axis of the case on its inside flat surfaces 55, are six sharply defined paralleled ridges 51. Three of the ridges 51 are located along one flat inside surface 55 and the other three are located along the opposite inside flat surface. Around the bottom surface of the case cavity are arranged four sharply defined ridges 53 which radiate toward the center axis and are located 90 degrees apart from each other.

The above described ridges serve to guide the clamshell assembly 60 into position and to prevent its rotation with respect to the case 50.

It should be noted that much of the detail in these drawings which is actually quite small, has been enlarged and therefore may appear to be out of proportion. This has been done to enhance the clarity of the device description and understanding.

The retainer case 50, in this embodiment, is depicted as being a generally cylindrical shape of hard, molded plastic. It can however, be made from any suitable rigid material that can be formed to have the desired internal cavity shape and properties. This depends on the selected manufacturing approach. A hard, molded plastic appears to be most economic as well as being very light in weight.

Figure 9:
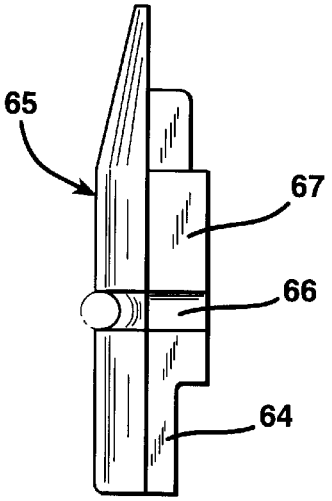
FIG. 9 is a side elevation view of one gripping member.
Figure 10:
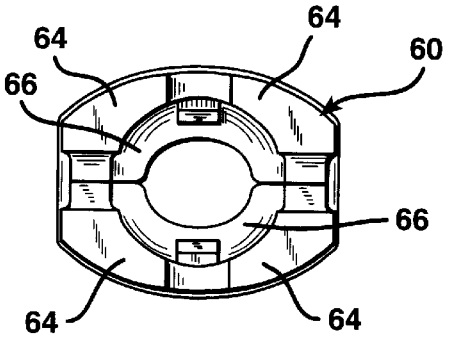
FIG. 10 is a bottom end view of a gripping assembly.
Figure 11:
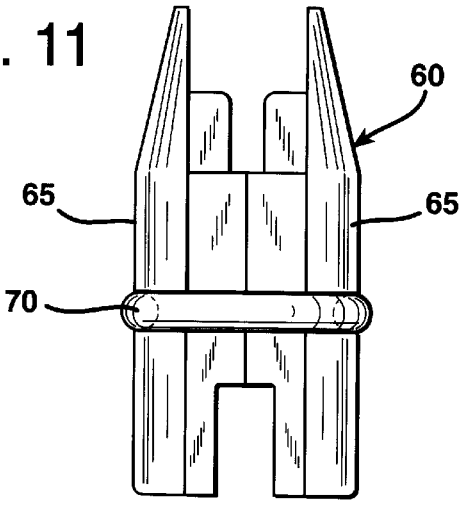
FIG. 11 is a side elevation view of a gripping assembly according to the present invention, particularly showing the two identical gripping members held together by an expandable split-ring.

Referring now to FIGS. 7, 8, 9, 10 and 11, there are shown details of the clamshell assembly 60. The clamshell assembly 60 comprises three parts: two identical half-sleeve members 65 and a split ring 70. The split ring 70 holds the two half-sleeve members 65 together as shown in FIG. 11.

Figure 7:
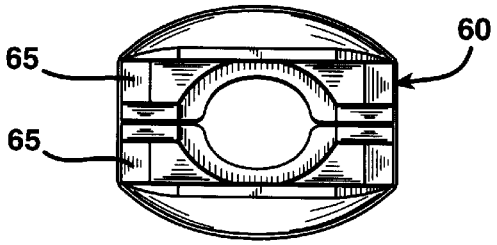
FIG. 7 is a top end view of a gripping assembly according to the present invention.

FIGS. 7 and 10 are respectively top and bottom end views of a clamshell assembly 60. In these views it can be seen that the assembly is approximately oval in cross-section, having two opposing, long convex curved sides and two opposing short straight sides. This shape has been found to be desirable for keying the assembly and also for rigidity.

In FIG. 10, the bottom end view of the assembly shows the gripping projections 66 held together and the shape of four projecting portions 64 that serve as pivoting ends for the clamshell members.

Figure 8:
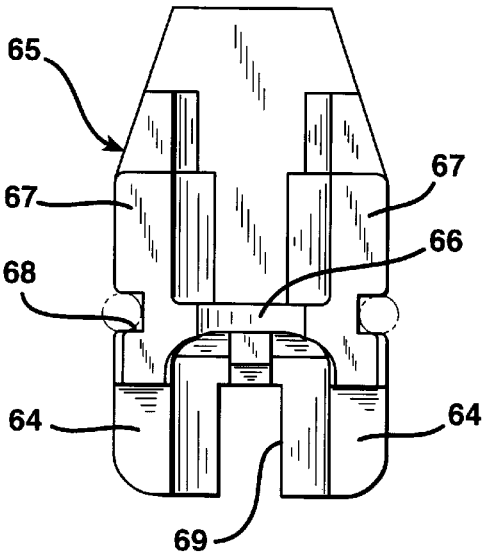
FIG. 8 is a an elevation view of one of two identical gripping members, particularly showing its internal surface.

FIGS. 8 and 9 present two views of a single half-sleeve 65: a front elevation view and a side or edge elevation view. FIG. 8 shows the inner view of the half-sleeve 65. The central portion of the surface is concave in shape, separated into two parts by a sharply projecting portion 66 part of which is cut away in a curve. This portion 66 is the gripping portion. A groove 68 is formed around the half-sleeve outer surface in line with the projecting ridge 66 to provide a seat for a split ring 70.

Flat surface portions 67 are sized to provide rigidity to each half-sleeve member so that it will not bend under applied leverage pressure. The lower portion of each half-sleeve member below the split-ring groove 68 is stepped 64, 69 to fit into the bottom of the retainer case cavity in its keyed position.

The two half-sleeve members 65 are formed of hard, rigid plastic which lends itself to the required described molding shape. However, other suitable moldable material could be used to produce the half-sleeve members 65 if so desired, providing the rigidity and shape requirements are met.

In the above described embodiment, a gripping means is provided using two opposing, curved rigid members, held together at a single point by an expandable split-ring.

The number of curved, rigid gripping members is not limited to two. For a large size diameter shaft, it may be desirable to use three or more gripping members, to provide the best grip. Three or more gripping members can be accommodated by revising the number of actuating cams on the lock shaft and their orientation, in addition to revising the shape of the retainer cavity and its keying means therein.

This method of gripping would work well and is practical for a large size shaft.

As described, the invention shaft retainer is capable of retaining different shaft configurations and sizes, using a single key to unlock the retainer. It can then be said to be a universal shaft retainer with many possible applications. The only requirement for its application is that the shaft incorporate one or more deep grooves, ridges or steps in its circumference near the shaft end.

The shaft retainer is small, light weight and economical to produce, resulting in low cost to the user. These attributes including its universal applications, make it a desirable device for commercial and individual users.

From the above description, it is clear that the preferred embodiment of the shaft retainer device achieves the objects of the present invention. Alternative embodiments and various modifications have been discussed herein and may also be apparent to those skilled in the art. These alternatives and modifications are considered to be within the spirit and scope of the present invention.

Having described the invention, what is claimed is:

1. A shaft retaining device comprising:

a shell having a first opening at its top end for access to an internal cavity and a second opening at the distal end of said shell which is sized for insertion of a radially grooved shaft end;

an unlocking means mounted and fastened in said first opening of said shell, said unlocking means including a key-operated lock that turns a projecting shaft and radially projecting cams that are fastened to said projecting shaft; and a leverable gripping means for gripping a radially grooved shaft end that may be inserted into said shell; said leverable gripping means including a multiplicity of rigid lever members, held together by an expandable split-ring which is mounted on the outer surface of said lever members, forming an expandable diameter radial gripping assembly; said lever members including a centrally located, curved first portion projecting from their inner surface for radially gripping the groove in an inserted shaft end; said lever members, when pushed outward at their upper ends by the cams of said unlocking means, and pivoting at their distal ends, releasing said first portion from gripping a shaft end that has been inserted into said gripping assembly, allowing said shaft end to be withdrawn or inserted.

2. A shaft retaining device, comprising:

a barrel shaped housing, having a first opening at one axial end and a second opening at its distal end;

a normally closed clamshell assembly including means for radially gripping a grooved shaft at the approximate center portion of said assembly; said clamshell assembly located axially inside said housing; and an unlocking assembly located in said first opening and interacting axially with said normally closed clamshell assembly; said unlocking assembly, when unlocked by a key, causing said normally closed clamshell assembly to be spread open and release a grooved shaft end that was inserted in said second opening of said housing.

3. A device as in claim 2, wherein said normally closed clamshell assembly comprised a multiplicity of gripping members and a split-ring; said split ring allowing said gripping members to be spread apart for insertion of a shaft end when said device is unlocked, and to retract and grip the shaft when said device is locked.

* * * * *